US011866276B2

(12) United States Patent
Yamada

(10) Patent No.: US 11,866,276 B2
(45) Date of Patent: Jan. 9, 2024

(54) MEDIUM CONVEYING APPARATUS

(71) Applicant: PFU Limited, Ishikawa (JP)

(72) Inventor: Eiki Yamada, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 179 days.

(21) Appl. No.: 17/568,279

(22) Filed: Jan. 4, 2022

(65) Prior Publication Data

US 2022/0289506 A1 Sep. 15, 2022

(30) Foreign Application Priority Data

Mar. 10, 2021 (JP) ..... 2021-037905

(51) Int. Cl.

| | |
|---|---|
| ***B65H 1/04*** | (2006.01) |
| ***B65H 7/20*** | (2006.01) |
| ***B65H 31/02*** | (2006.01) |
| ***B65H 7/04*** | (2006.01) |

(52) U.S. Cl.

CPC ..... *B65H 1/04* (2013.01); *B65H 7/04* (2013.01); *B65H 7/20* (2013.01); *B65H 31/02* (2013.01); *B65H 2301/4212* (2013.01); *B65H 2405/111643* (2013.01); *B65H 2405/324* (2013.01)

(58) Field of Classification Search

CPC ..... B65H 1/04; B65H 1/027; B65H 2402/44; B65H 2402/441; B65H 2402/45; B65H 2405/1116; B65H 2405/11164; B65H 2405/111643; B65H 2405/1117; B65H 2405/11172; B65H 2405/115; B65H 2405/12; B65H 2405/324

See application file for complete search history.

(56) References Cited

U.S. PATENT DOCUMENTS 5,975,520 A * 11/1999 Shim ..... B65H 1/04 271/223
2005/0285330 A1* 12/2005 Tazika ..... B41J 13/103 271/157

(Continued)

FOREIGN PATENT DOCUMENTS

| | | | |
|---|---|---|---|
| JP | 08-244986 | A | 9/1996 |
| JP | 2002-240986 | A | 8/2002 |
| JP | 2008-114937 | A | 5/2008 |

(Continued)

*Primary Examiner* — Prasad V Gokhale
(74) *Attorney, Agent, or Firm* — Rimon P.C.; Tomoki Tanida

(57) ABSTRACT

A medium conveying apparatus includes a main body, a placement board that is movably supported by the main body, an extension member that is movably supported by the placement board, a lever that is movably supported by the placement board, and a mechanism that moves the extension member to a contraction position when the lever is located at a protrusion position, and moves the extension member to an expansion position when the lever is located at a pushed position, wherein the lever is away from an abutting portion fixed to the main body when the placement board is located between a storage position and a midway position, and the lever comes into contact with the abutting portion and moves toward the pushed position when the placement board is located between a unfolding position and the midway position and when the placement board moves toward the unfolding position.

7 Claims, 12 Drawing Sheets

(56) References Cited

U.S. PATENT DOCUMENTS

| | | | | |
|---|---|---|---|---|
| 2014/0070482 | A1* | 3/2014 | Matsumoto | B65H 7/00<br>271/162 |
| 2018/0215561 | A1* | 8/2018 | Mori | H04N 1/0053 |

FOREIGN PATENT DOCUMENTS

| | | | |
|---|---|---|---|
| JP | 2014-051361 | A | 3/2014 |
| JP | 2018-135173 | A | 8/2018 |

* cited by examiner

MEDIUM CONVEYING APPARATUS

CROSS-REFERENCE TO RELATED APPLICATION

This application is based upon and claims the benefit of priority of the prior Japanese Patent Application No. 2021-037905, filed on Mar. 10, 2021, the entire contents of which are incorporated herein by reference.

FIELD

The technology disclosed in the present disclosure relates to a medium conveying apparatus.

BACKGROUND

A medium conveying apparatus with an extension member that holds a portion of a medium, which is placed on a placement board, protruding from a placement board has been known (Japanese Laid-open Patent Publication No. 2014-51361, Japanese Laid-open Patent Publication No. 2002-240986, and Japanese Laid-open Patent Publication No. 2018-135173). This medium conveying apparatus is able to prevent deviation or drop of the medium from the placement board due to the weight of the protruding portion. Furthermore, this medium conveying apparatus extends the extension member by working together with an operation of unfolding the placement board and thus improve operability of users.

However, there is a problem in that, when the medium conveying apparatus as described above extends the extension member by mechanically working together with an operation of unfolding the placement board, a force needed to unfold the placement board increases.

SUMMARY

According to an aspect of an embodiment, a medium conveying apparatus includes a main body in which a conveying path for conveying a medium is formed, a placement board that is supported by the main body so as to be rotatable about a rotation axis such that the placement board moves between a storage position and an unfolding position via a midway position, and on which the medium is placed, an extension member that is movably supported by the placement board so as to move between a contraction position and an expansion position, a lever that is movably supported by the placement board so as to move between a protrusion position and a pushed position, and a mechanism that converts a motion of the lever to a motion of the extension member such that the extension member is located at the contraction position when the lever is located at the protrusion position, and the extension member is located at the expansion position when the lever is located at the pushed position, wherein the lever is away from an abutting portion fixed to the main body when the placement board is located in a separation section between the storage position and the midway position, and the lever comes into contact with the abutting portion and moves toward the pushed position when the placement board is located in a contact section between the unfolding position and the midway position and when the placement board moves toward the unfolding position.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Figure 1:
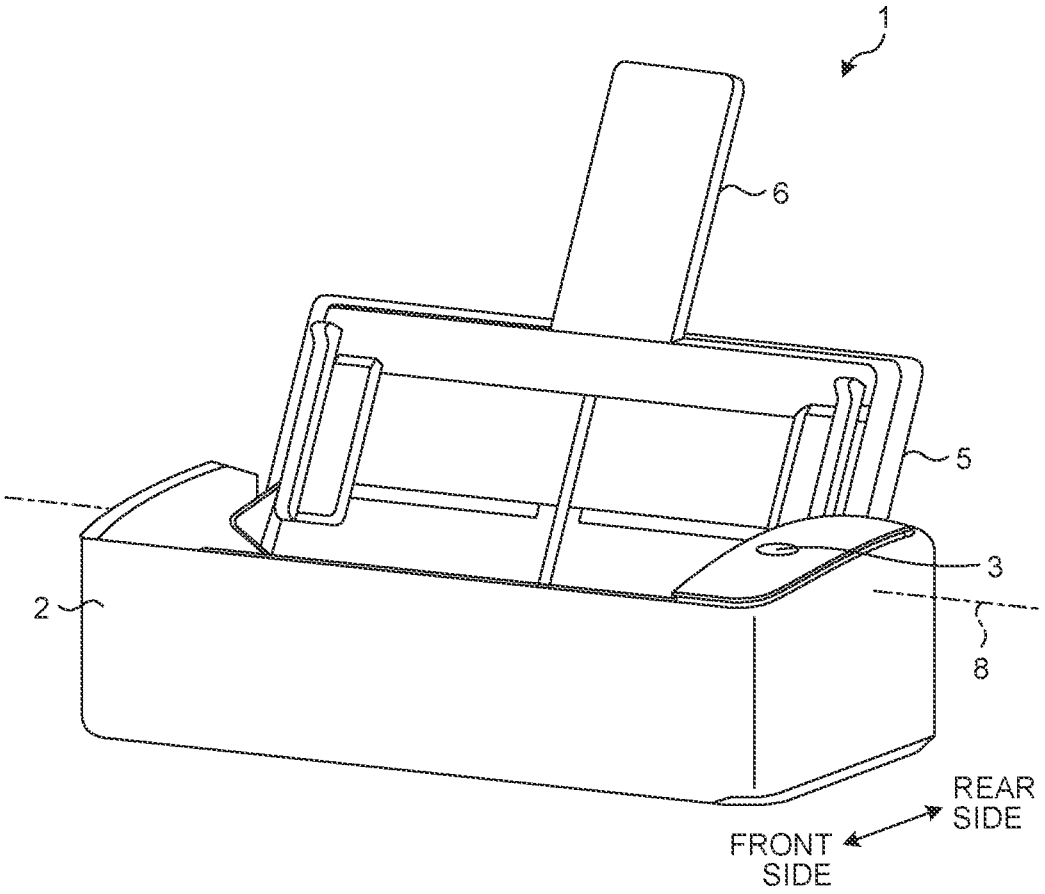
FIG. 1 is a perspective view illustrating an image reading apparatus that includes a medium conveying apparatus according to a first embodiment.

Preferred embodiments of a medium conveying apparatus disclosed in the present disclosure will be explained below with reference to the accompanying drawings. Furthermore, the technology of the present disclosure is not limited to the embodiments. Furthermore, in the description below, the same reference numerals are assigned to the same components and descriptions of overlapping portions will be omitted.

First Embodiment

As illustrated in FIG. 1, a medium conveying apparatus according to a first embodiment is arranged on an image reading apparatus 1. FIG. 1 is a perspective view illustrating the image reading apparatus 1 that includes the medium conveying apparatus according to the first embodiment. The image reading apparatus 1 includes a main body 2, a scan button 3, a placement board 5, and an extension member 6. The main body 2 is formed in a substantially box shape. The scan button 3 is arranged on the upper side of the main body 2. The scan button 3 detects whether the scan button 3 is pressed by a user of the image reading apparatus 1.

Figure 2:
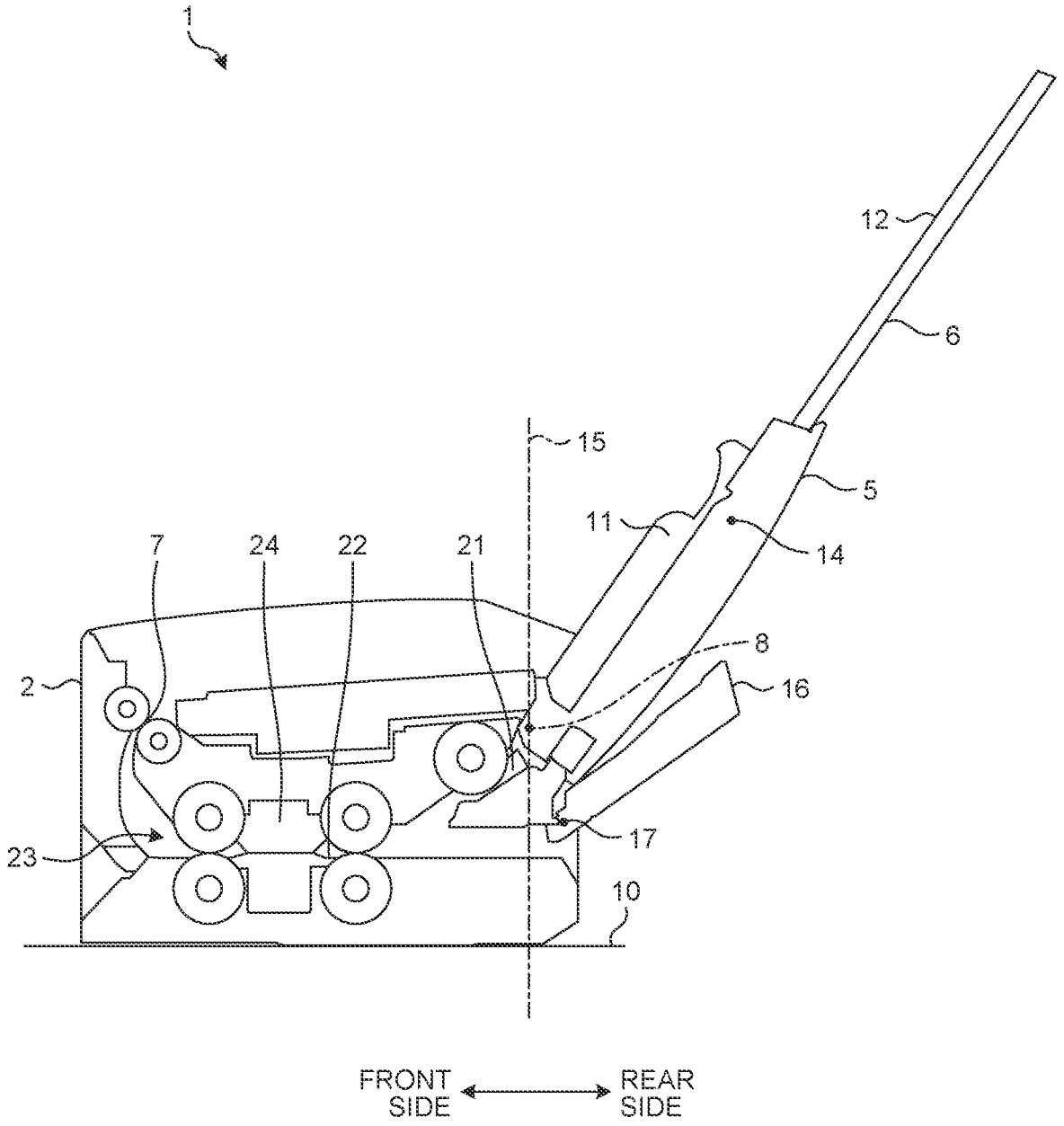
FIG. 2 is a side surface sectional view illustrating an image reading apparatus.

The placement board 5 is supported by the main body 2 so as to be rotatable about a rotation axis 8 such that the placement board 5 is arranged at an unfolding position or a storage position. FIG. 2 is a side surface sectional view illustrating the image reading apparatus 1. The main body 2 is placed on an installation surface 10 on which the image reading apparatus 1 is installed. The rotation axis 8 is parallel to a plane along which the installation surface 10 is formed. The placement board 5 has a main body placement surface 11 formed thereon. The plane along which the main body placement surface 11 is formed is parallel to the rotation axis 8. The main body placement surface 11 is oriented obliquely upward when the placement board 5 is located at the unfolding position. The extension member 6 is formed in a substantially plate shape. The extension member 6 has an extension member placement surface 12 formed thereon. The extension member 6 is arranged such that the extension member placement surface 12 is parallel to a plane along the main body placement surface 11, and is movably supported by the placement board 5.

A center of gravity 14 of the placement board 5 and the extension member 6 is located on a rear side of a vertical plane 15 when the placement board 5 is located at the unfolding position. The vertical plane 15 overlaps with the rotation axis 8 and is perpendicular to the plane along which the installation surface 10 is formed. Accordingly, gravity is added to the placement board 5 and the extension member 6 so as to rotate clockwise about the rotation axis 8 in FIG. 2 when the installation surface 10 is parallel to a horizontal plane and when the placement board 5 is located at the unfolding position.

The image reading apparatus 1 further includes a cover 16. The cover 16 is formed in a substantially plate shape. The cover 16 is supported by the main body 2 so as to be rotatable about a rotation axis 17. The rotation axis 17 is parallel to the rotation axis 8. The image reading apparatus 1 further includes a cover opening-and-closing mechanism that is not illustrated. The cover opening-and-closing mechanism moves the cover 16 toward the opening position when the placement board 5 moves from the storage position toward the unfolding position and arranges the cover 16 at an opening position. The cover opening-and-closing mechanism moves the cover 16 toward the closing position when the placement board 5 is located at the storage position and arranges the cover 16 at a closing position.

The main body 2 has an insertion port 21, a discharge port 7, and a conveying path 22 formed thereon. The insertion port 21 is formed on the rear side of the main body 2. The discharge port 7 is formed on an upper side of the front side of the main body 2. The conveying path 22 is formed inside the main body 2. The insertion port 21 and the discharge port 7 are connected via the conveying path 22.

The image reading apparatus 1 further includes a conveying unit 23 and a reading unit 24. The conveying unit 23 is arranged inside the main body 2. The conveying unit 23 supplies, to the conveying path 22, a single medium out of a plurality of media inserted into the insertion port 21, conveys the single medium located on the conveying path 22 to the discharge port 7 along the conveying path 22, and discharges the medium conveyed along the conveying path 22 from the discharge port 7. The reading unit 24 captures an image of the medium conveyed along the conveying path 22.

Figure 3:
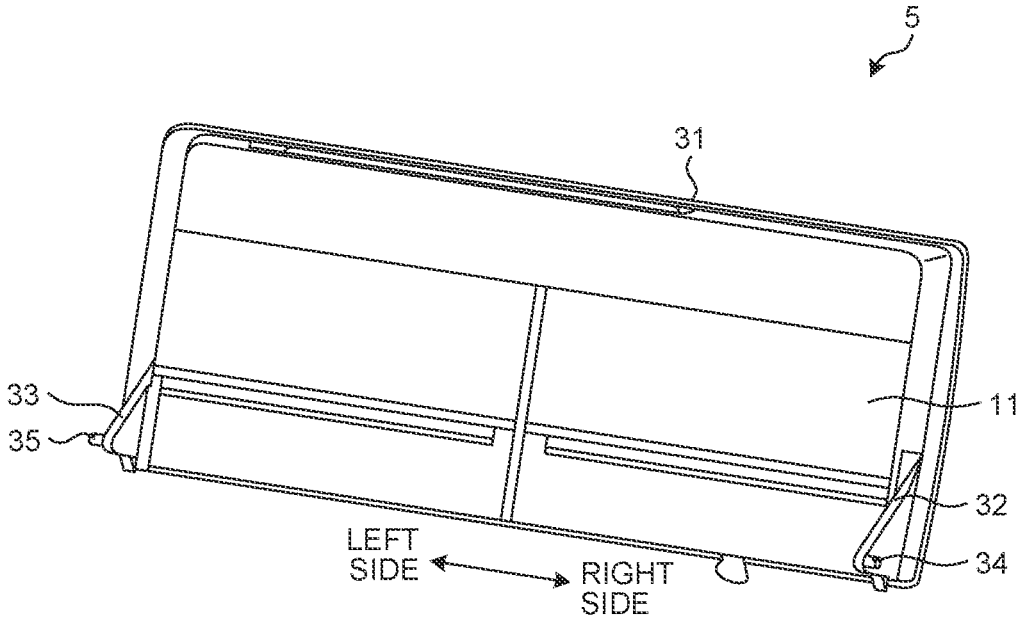
FIG. 3 is a perspective view illustrating a placement board.

FIG. 3 is a perspective view illustrating the placement board 5. The placement board 5 includes a placement board main body 31, a right side supporting portion 32, a left side supporting portion 33, a right side hinge pin 34, and a left side hinge pin 35. The placement board main body 31 is formed in a plate shape. The placement board main body 31 has the main body placement surface 11 formed thereon. The right side supporting portion 32 is formed in a plate shape. The right side supporting portion 32 is arranged so as to protrude from the right end of the placement board main body 31 in a direction of the orientation of the main body placement surface 11 and so as to be along the plane that is perpendicular to the rotation axis 8, and is fixed to the placement board main body 31. The left side supporting portion 33 is formed in a plate shape. The left side supporting portion 33 is arranged so as to protrude from the left end of the placement board main body 31 in a direction of the orientation of the main body placement surface 11 and so as to be along the plane that is perpendicular to the rotation axis 8, and is fixed to the placement board main body 31.

The right side hinge pin 34 is formed in a rod shape. The right side hinge pin 34 is arranged along the rotation axis 8 so as to protrude from the right side supporting portion 32 to the right side, and is fixed to the right side supporting portion 32, i.e., is fixed to the placement board main body 31 via the right side supporting portion 32. The left side hinge pin 35 is formed in a rod shape. The left side hinge pin 35 is arranged along the rotation axis 8 so as to protrude from the left side supporting portion 33 to the left side, and is fixed to the left side supporting portion 33, i.e., is fixed to the placement board main body 31 via the left side supporting portion 33. The placement board 5 is formed such that the plane along which the main body placement surface 11 is formed does not overlap with the rotation axis 8. The main body 2 has two hinge pin fitting holes (not illustrated) formed therein. The placement board 5 is supported by the main body 2 so as to be rotatable about the rotation axis 8 as a result of the right side hinge pin 34 and the left side hinge pin 35 being fitted into the two hinge pin fitting holes.

The right side hinge pin 34 and the left side hinge pin 35 are able to approach each other due to elastic deformation of the right side supporting portion 32 and the left side supporting portion 33. The right side hinge pin 34 and the left side hinge pin 35 are able to be away from the two hinge pin fitting holes as a result of these pins approaching each other. The right side hinge pin 34 and the left side hinge pin 35 are arranged at a predetermined position when these pins approach each other and the elastic deformation of the right side supporting portion 32 and the left side supporting portion 33 are recovered, so that these pins are able to be fitted into the two hinge pin fitting holes. In other words, in the image reading apparatus 1, by forming the placement board 5 in this way, a user is able to easily perform an operation of attaching the placement board 5 to the main body 2 and removing the placement board 5 from the main body 2.

Figure 4:
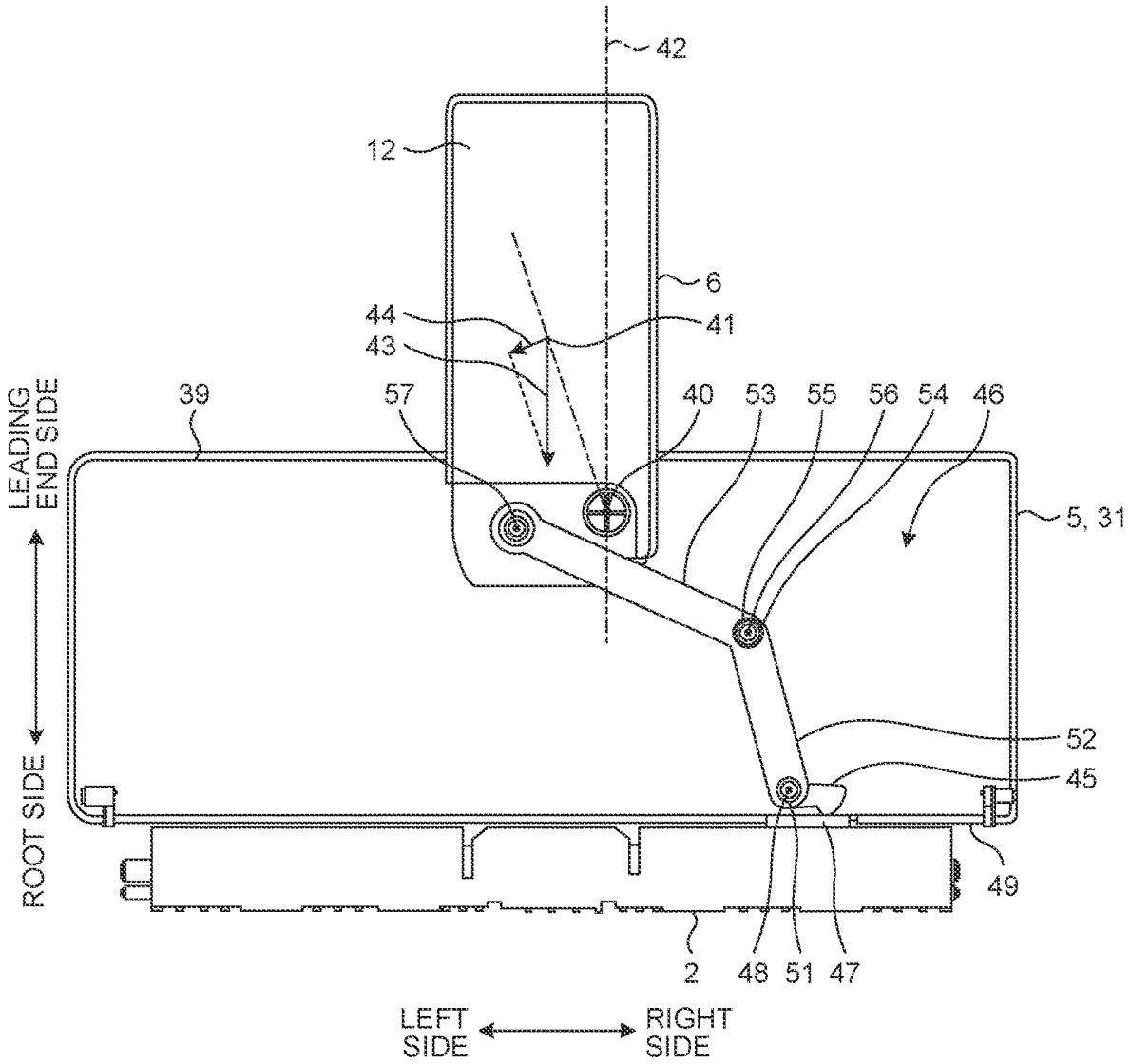
FIG. 4 a plan view illustrating the placement board and an extension member.

FIG. 4 is a plan view illustrating the placement board 5 and the extension member 6. The extension member 6 is supported by the placement board main body 31 included in the placement board 5 so as to be rotatable about a rotation axis 40 such that the extension member 6 is located at an expansion position or a contraction position. The rotation axis 40 is perpendicular to a plane along which the main body placement surface 11 is formed, i.e., perpendicular to a plane along which the extension member placement surface 12 of the extension member 6 is formed. The extension member 6 protrudes from an end 39 on the leading end side of the placement board main body 31 included in the placement board 5 to the leading end side when the extension member 6 is located at the expansion position.

The image reading apparatus 1 further includes a lever 45, an expansion-and-contraction mechanism 46, and a body side abutting portion 47. The lever 45 is formed in a rod shape. The lever 45 is supported by the placement board main body 31 so as to be rotatable about a rotation axis 48 such that the lever 45 is located at a pushed position or a protrusion position. The rotation axis 48 is parallel to the rotation axis 40. The lever 45 is located inside the placement board main body 31 without protruding from an end 49 on the root side of the placement board main body 31 included in the placement board 5 when the lever 45 is located at the pushed position.

The expansion-and-contraction mechanism 46 includes a spring 51, a lever side link 52, and an extension member link 53. The spring 51 is formed by a torsion coil spring. One end of the spring 51 is fixed to the placement board main body 31 and the other end of the spring 51 is fixed to the lever 45. The spring 51 is elastically deformed and applies an elastic force to the lever 45 such that the lever 45 moves toward the protrusion position when the lever 45 is located at the pushed position.

The lever side link 52 is formed in a rod shape. The lever side link 52 is supported by the placement board main body 31 so as to be rotatable about the rotation axis 48 and is fixed to the lever 45. A fitting hole 54 is formed at the other end of the lever side link 52, which is the end opposite to one end linked to the lever 45. The extension member link 53 is formed in a rod shape. A pin 55 is formed at one end of the extension member link 53. The extension member link 53 is supported by the lever side link 52 so as to be rotatable about a rotation axis 56 as a result of the pin 55 being fitted into the fitting hole 54. The rotation axis 56 is parallel to the rotation axis 40. The extension member link 53 is further supported by the extension member 6 so as to be rotatable about a rotation axis 57. The rotation axis 57 is parallel to the rotation axis 40.

By being formed as described above, the expansion-and-contraction mechanism 46 converts a motion of the lever 45 to a motion of the extension member 6 such that the extension member 6 is located at another position associated with a position at which the lever 45 is located. For example, the expansion-and-contraction mechanism 46 is formed such that the extension member 6 is located at the expansion position when the lever 45 is located at the pushed position. The expansion-and-contraction mechanism 46 is formed such that the extension member 6 is located at the contraction position when the lever 45 is located at the protrusion position.

A center of gravity 41 of the extension member 6 is located on the left side of a vertical plane 42 when the extension member 6 is located at the expansion position. The vertical plane 42 overlaps with the rotation axis 40 and is perpendicular to a plane along which the installation surface 10 is formed. Accordingly, a component force 44 of gravity 43 added to the extension member 6 is added such that the extension member 6 rotates counterclockwise about the rotation axis 40 in FIG. 4 against a frictional force added to the expansion-and-contraction mechanism 46 when the installation surface 10 is along the horizontal plane and when the extension member 6 is located at the expansion position. The extension member 6 moves toward the contraction position as a result of rotating counterclockwise about the rotation axis 40 in FIG. 4.

Figure 5:
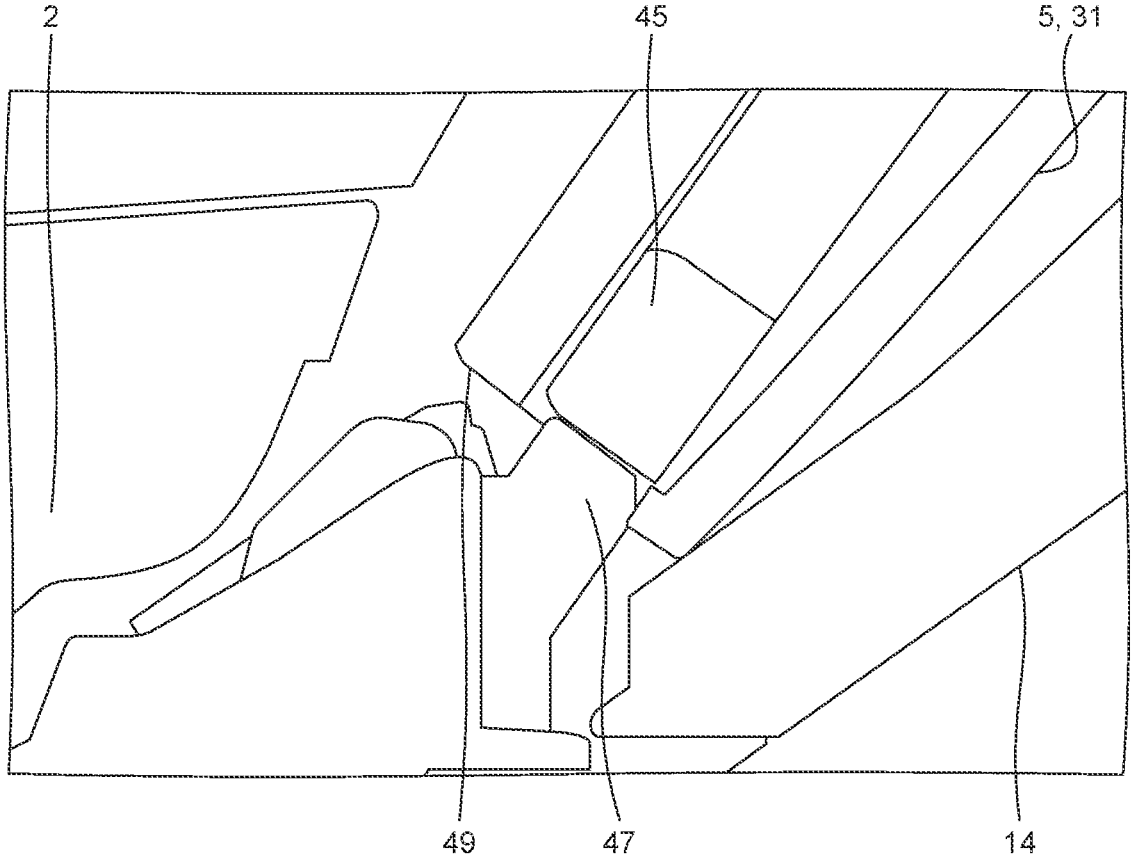
FIG. 5 is a side surface sectional view illustrating a lever and a body side abutting portion when the placement board is located at an unfolding position.

The body side abutting portion 47 is fixed to the main body 2. The body side abutting portion 47 is closest to the end 49 of the placement board main body 31 included in the placement board 5 as illustrated in FIG. 5 when the placement board 5 is located at the unfolding position. FIG. 5 is a side surface sectional view illustrating the lever 45 and the body side abutting portion 47 when the placement board 5 is located at the unfolding position. The lever 45 is located at the pushed position as a result of the lever 45 coming into contact with the body side abutting portion 47 and being pushed into the body side abutting portion 47 when the placement board 5 is located at the unfolding position. Gravity of the placement board 5 and the extension member 6 is added to the placement board 5 such that the placement board 5 moves toward the unfolding position. An elastic force of the spring 51 is small enough for the placement board 5 not to move toward the storage position via the lever 45 when the placement board 5 is located at the unfolding position.

Figure 6:
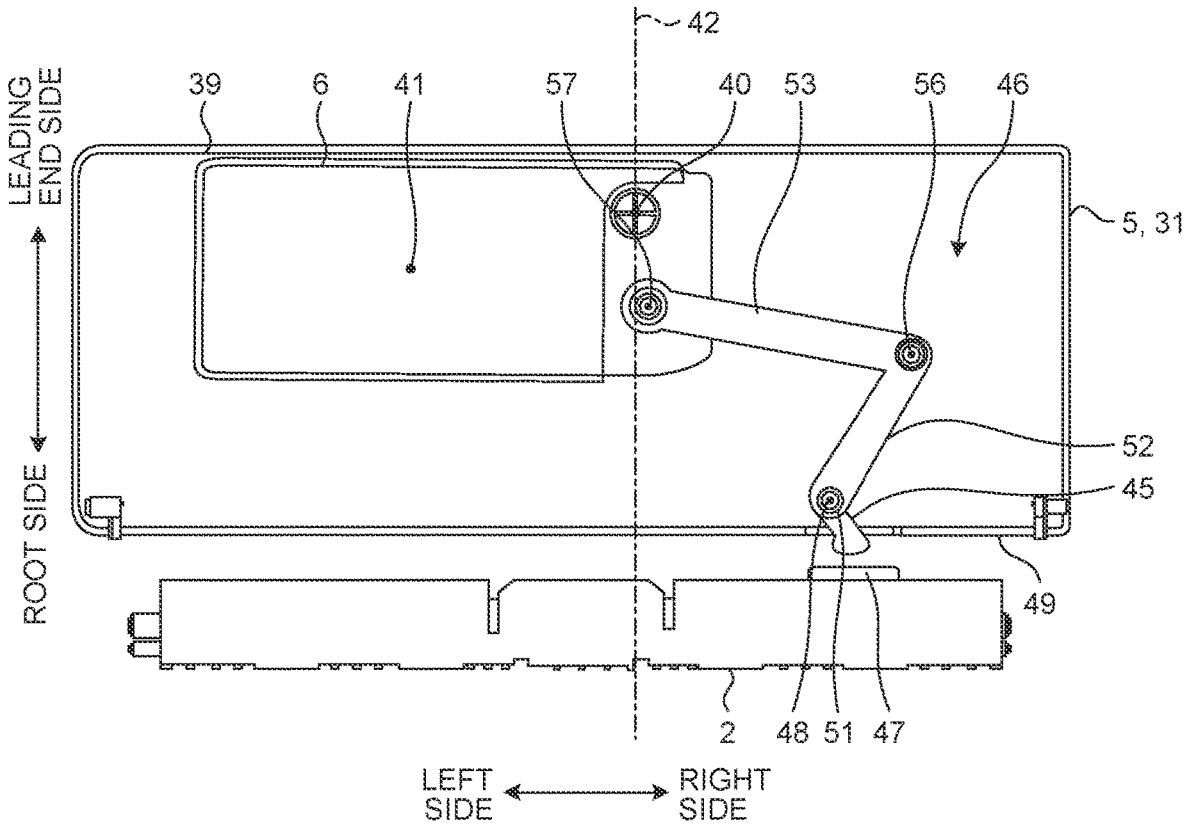
FIG. 6 is a plan view illustrating the lever and an expansion-and-contraction mechanism when the extension member is located at a contraction position.

FIG. 6 is a plan view illustrating the lever 45 and the expansion-and-contraction mechanism 46 when the extension member 6 is located at the contraction position. The extension member 6 is located inside the placement board main body 31 without protruding from the end 39 of the leading end side of the placement board main body 31 when the extension member 6 is located at the contraction position. The center of gravity 41 of the extension member 6 is located on the left side of the vertical plane 42 when the extension member 6 is located at the contraction position.

The lever 45 is located at the protrusion position by the expansion-and-contraction mechanism 46 when the extension member 6 is located at the contraction position. The lever 45 protrudes from the end 49 of the placement board main body 31 included in the placement board 5 to the root side when the lever 45 is located at the protrusion position. The spring 51 is elastically deformed and applies an elastic force to the lever 45 so as to resist a force of the lever 45 moving toward the pushed position when the lever 45 is located at the protrusion position.

Figure 7:
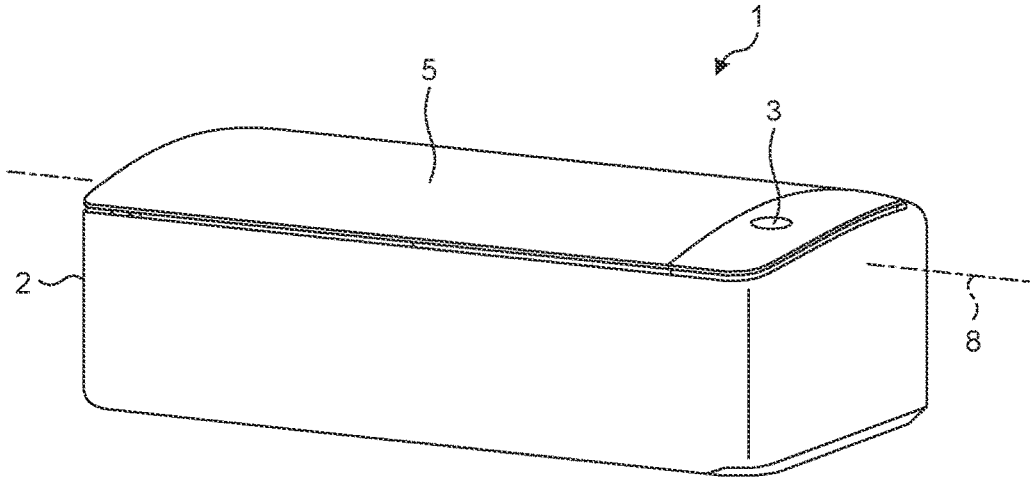
FIG. 7 is a perspective view illustrating the image reading apparatus when the placement board is located at a storage position.

FIG. 7 is a perspective view illustrating the image reading apparatus 1 when the placement board 5 is located at the storage position. The placement board 5 is able to be appropriately located at the storage position when the extension member 6 is located at the contraction position. The placement board 5 is located at the upper side of the main body 2 and is stored in the main body 2 when the placement board 5 is located at the storage position. The center of gravity 14 of the placement board 5 and the extension member 6 is arranged closer to the front side of the vertical plane 15 when the placement board 5 is located at the storage position. Accordingly, gravity of the placement board 5 and the extension member 6 is added to the placement board 5 such that the placement board 5 rotates counterclockwise about the rotation axis 8 in FIG. 7 when the installation surface 10 is along the horizontal plane and when the placement board 5 is located at the storage position.

Figure 8:
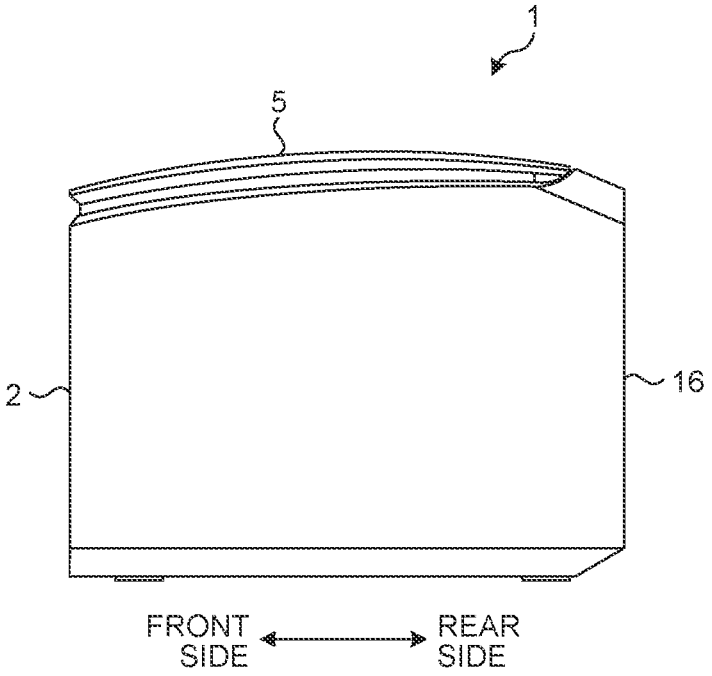
FIG. 8 is a side view illustrating the image reading apparatus when the placement board is located at the storage position.

As illustrated in FIG. 8, the cover 16 is located at the closing position when the placement board 5 is located at the storage position. FIG. 8 is a side view illustrating the image reading apparatus 1 when the placement board 5 is located at the storage position. In other words, the cover opening-and-closing mechanism allows the cover 16 to move toward the closing position and to be located at the closing position when the placement board 5 is located at the storage position. The cover 16 is located on the rear side of the main body 2 and stored in the main body 2 when the cover 16 is located at the closing position.

Figure 9:
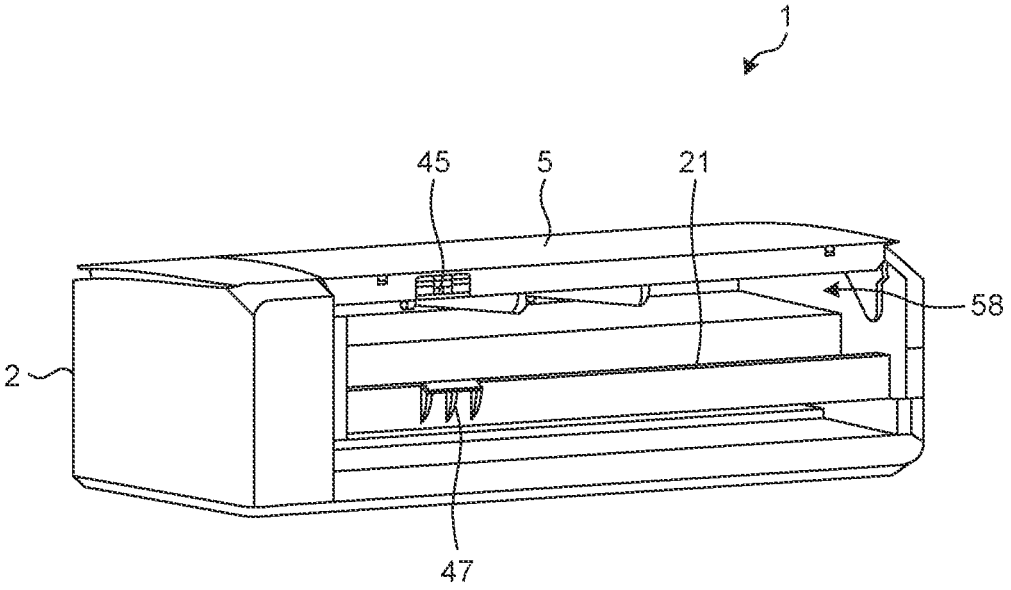
FIG. 9 is a perspective view illustrating the image reading apparatus from which a cover is removed.

FIG. 9 is a perspective view illustrating the image reading apparatus 1 from which the cover 16 is removed. A rear side opening portion 58 is formed on the rear side of the main body 2. The insertion port 21, the lever 45, and the body side abutting portion 47 are exposed outside via the rear side opening portion 58 when the placement board 5 is located at the storage position and when the cover 16 is removed.

Figure 10:
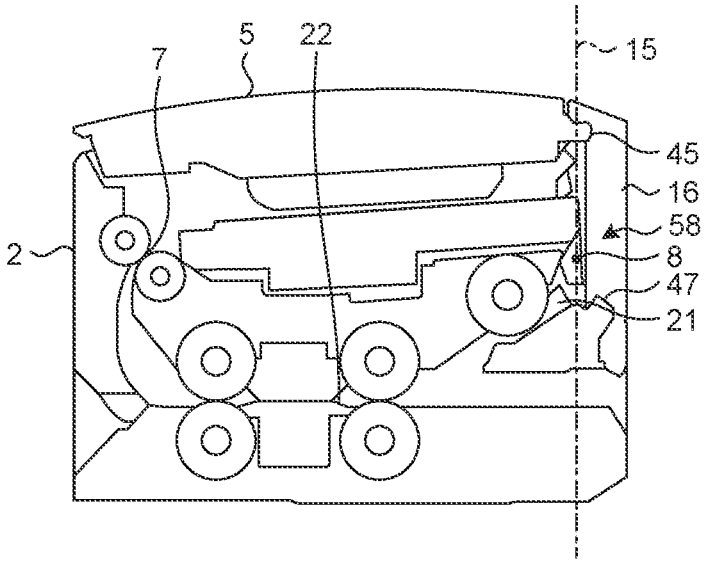
FIG. 10 is a side surface sectional view illustrating the image reading apparatus when the cover is located at a closing position.

FIG. 10 is a side surface sectional view illustrating the image reading apparatus 1 when the cover 16 is located at the closing position. The cover 16 covers the rear side opening portion 58 when the cover 16 is located at the closing position. The insertion port 21, the lever 45, and the body side abutting portion 47 are covered by the cover 16 when the rear side opening portion 58 is closed by the cover 16. The image reading apparatus 1 is able to prevent a foreign object from entering the insertion port 21 and the conveying path 22 as a result of the insertion port 21, the lever 45, and the body side abutting portion 47 being covered by the cover 16, and is able to prevent a foreign object from being attached to the lever 45 and the body side abutting portion 47.

Figure 11:
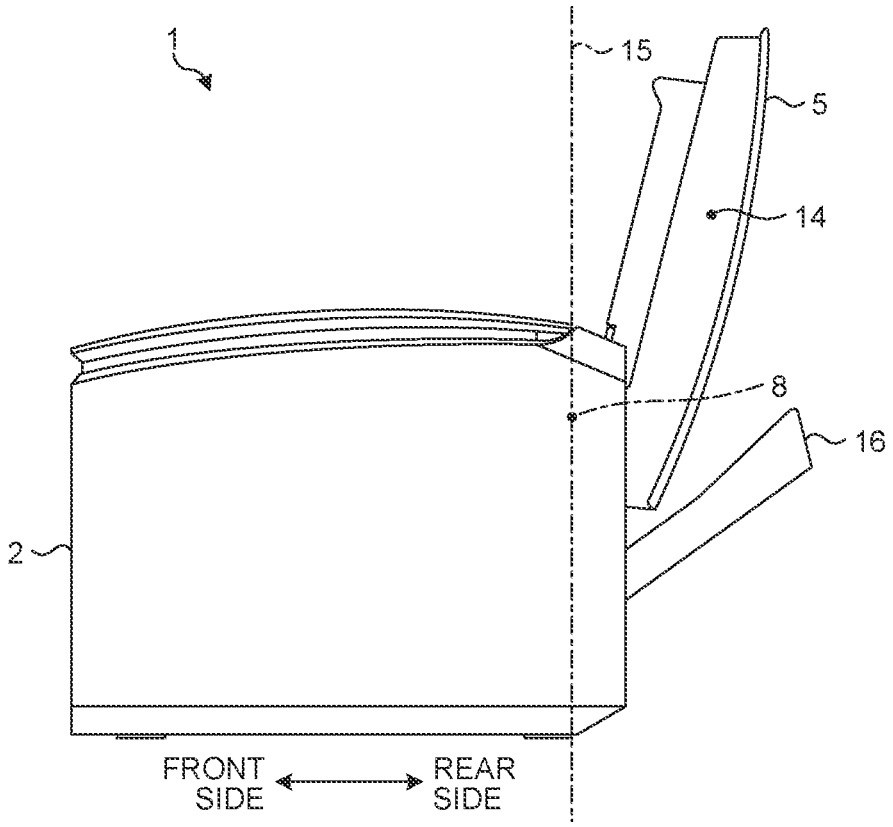
FIG. 11 is a side view illustrating the image reading apparatus when the placement board is located at a midway position.

As illustrated in FIG. 11, the placement board 5 is located at a midway position along a movement of the placement board 5 from the unfolding position to the storage position or from the storage position to the unfolding position. FIG. 11 is a side view illustrating the image reading apparatus 1 when the placement board 5 is located at the midway position. The center of gravity 14 of the placement board 5 and the extension member 6 is located on the rear side of the vertical plane 15 when the placement board 5 is located at the midway position. A height of the center of gravity 14 when the placement board 5 is located at the midway position is higher than that of the center of gravity 14 when the placement board 5 is located at the unfolding position. A height at a certain point is equal to a length of a perpendicular line extending from that point to the plane along which the installation surface 10 is formed. Accordingly, gravity of the placement board 5 and the extension member 6 is added to the placement board 5 such that the placement board 5 moves toward the unfolding position, i.e., the placement board 5 rotates clockwise about the rotation axis 8 in FIG. 11 when the installation surface 10 is along the horizontal plane and when the placement board 5 is located at the midway position.

Figure 12:
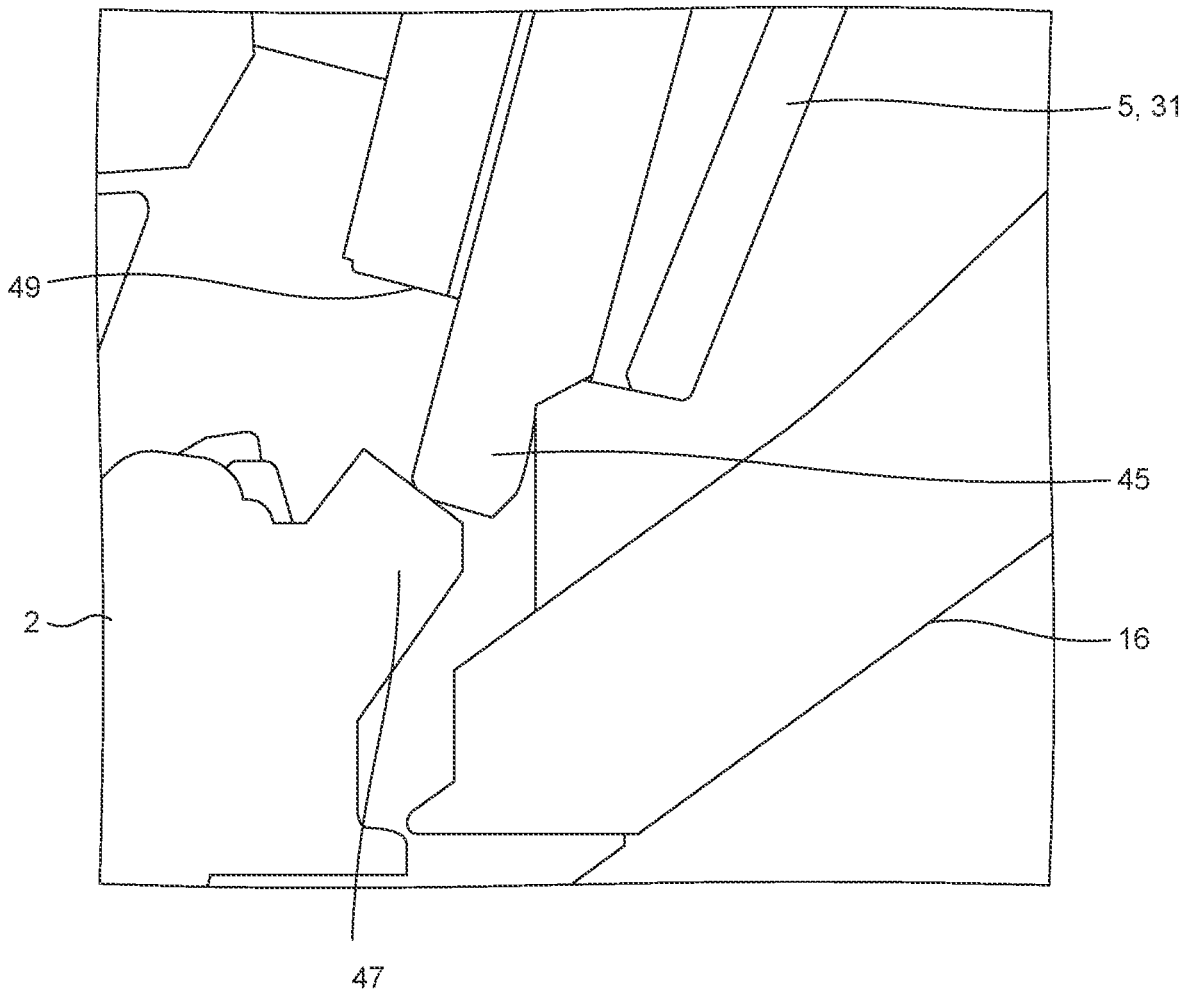
FIG. 12 is a side surface sectional view illustrating the lever and a body side abutting portion when the placement board is located at the midway position.

FIG. 12 is a side surface sectional view illustrating the lever 45 and the body side abutting portion 47 when the placement board 5 is located at the midway position. The body side abutting portion 47 is away from the end 49 of the placement board main body 31 included in the placement board 5 when the placement board 5 is located at the midway position. The lever 45 is located at the protrusion position and protrudes from the end 49 of the placement board main body 31 to the root side when the placement board 5 is located at the midway position. The lever 45 further comes into contact with the body side abutting portion 47 when the placement board 5 is located at the midway position.

Figure 13:
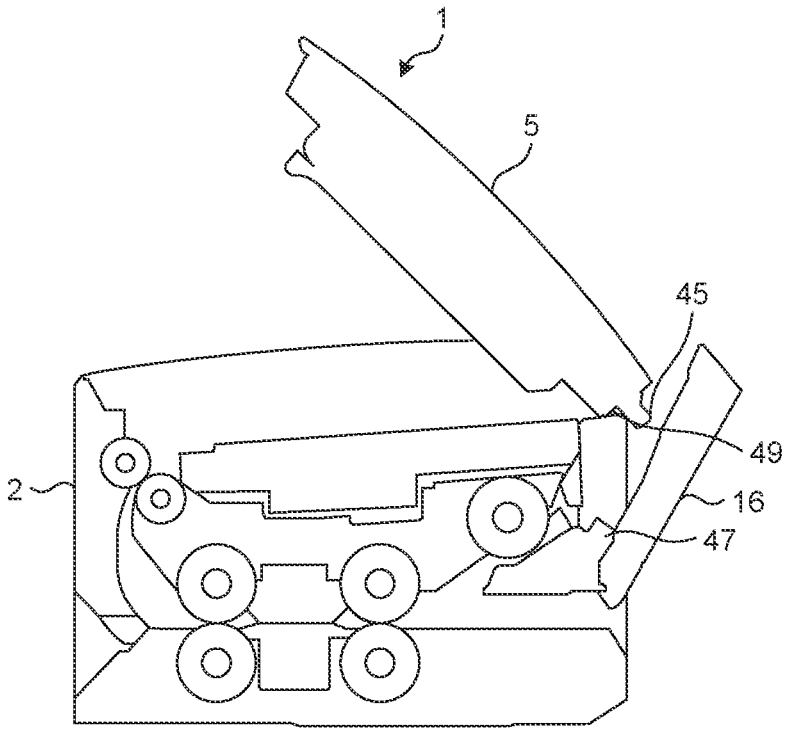
FIG. 13 is a side surface sectional view illustrating the image reading apparatus when the placement board is located at a separation section.

As illustrated in FIG. 13, the lever 45 is located at the protrusion position and protrudes from the end 49 of the placement board main body 31 to the root side when the placement board 5 is located in the separation section between the storage position and the midway position. FIG. 13 is a side surface sectional view illustrating the image reading apparatus 1 when the placement board 5 is located in the separation section. The lever 45 is further away from the body side abutting portion 47 when the placement board 5 is located in the separation section.

Operation of Image Reading Apparatus 1

When a user desires to read images of a plurality of media by using the image reading apparatus 1 and when the placement board 5 is located at the storage position, the user rotates the placement board 5 toward the unfolding position and arranges the placement board 5 at the unfolding position. The cover 16 is located at the closing position when the placement board 5 is located at the storage position. The extension member 6 is located at the contraction position when the placement board 5 is located at the storage position. The lever 45 is located at the protrusion position by the expansion-and-contraction mechanism 46 when the extension member 6 is located at the contraction position. The lever 45 is further fixed to the placement board 5 in the state where the lever 45 is located at the protrusion position by an elastic force applied by the spring 51. Gravity of the placement board 5 and the extension member 6 is added to the placement board 5 so as to resist a force of the placement board 5 moving toward the unfolding position when the placement board 5 is located at the storage position.

The cover 16 moves toward the opening position by the cover opening-and-closing mechanism and is located at the opening position when the placement board 5 moves from the storage position to the unfolding position. The placement board 5 passes through the midway position when moving from the storage position to the unfolding position. The lever 45 is fixed to the placement board 5 by the spring 51 in the state where the lever 45 is located at the protrusion position without being in contact with the body side abutting portion 47 when the placement board 5 is located in the separation section that is located between the storage position and the midway position. The extension member 6 is fixed to the placement board 5 in the state where the extension member 6 is located at the contraction position as a result of the lever 45 being fixed to the protrusion position. A force that causes the placement board 5 to rotate toward the midway position in the separation section only works against the gravity of the placement board 5 and the extension member 6 and is relatively small as a result of rotation of the placement board 5 not being converted to rotation of the extension member 6.

The lever 45 comes into contact with the body side abutting portion 47 when the placement board 5 is located in the contact section that is located between the midway position and the unfolding position. The end 49 of the placement board main body 31 included in the placement board 5 approaches the body side abutting portion 47 as a result of the placement board 5 moving toward the unfolding position. The lever 45 is pushed into the body side abutting portion 47 and moves toward the pushed position as a result of the placement board 5 moving toward the unfolding position when the placement board 5 is located in the contact section. The extension member 6 moves toward an extension position by the expansion-and-contraction mechanism 46 when the lever 45 moves toward the pushed position.

In other words, a motion of the placement board 5 moving toward unfolding position in the contact section is converted to a motion of the extension member 6 moving toward the extension position by the lever 45, the expansion-and-contraction mechanism 46, and the body side abutting portion 47. Accordingly, the force that causes the placement board 5 to move toward the unfolding position in the contact section includes a force that causes the extension member 6 to move toward the extension position. The gravity of the placement board 5 and the extension member 6 is added to the placement board 5 such that the placement board 5 moves toward the unfolding position when the placement board 5 is located in the contact section. A force that is needed for the placement board 5 to move toward the unfolding position in the contact section is reduced as a result of the gravity of the placement board 5 and the extension member 6 being added to the placement board 5.

The lever 45 is located at the pushed position as a result of the lever 45 being pushed into the body side abutting portion 47 when the placement board 5 is located at the unfolding position. The extension member 6 is located at the extension position by the expansion-and-contraction mechanism 46 when the lever 45 is located at the pushed position.

The user places a plurality of media that are desired to be read by the user on the placement board 5 when the placement board 5 is located at the unfolding position and when the extension member 6 is located at the expansion position. At this time, a portion of the plurality of media protruding from the placement board 5 is placed on the extension member 6, thereby the image reading apparatus 1 is able to prevent deviation or drop of the media due to the weight of the protruding portion. The plurality of media move toward the insertion port 21 and are inserted into the insertion port 21 due to gravity as a result of the main body placement surface 11 being oriented obliquely upward when the media are placed on the placement board 5. The user starts up the image reading apparatus 1 by pressing the scan button 3 after the plurality of media have been inserted into the insertion port 21.

After the image reading apparatus 1 has been started up, the conveying unit 23 supplies, one by one, the plurality of media inserted into the insertion port 21 to the conveying path 22. The conveying unit 23 conveys a single medium, which has been supplied on the conveying path 22, along the conveying path 22. The reading unit 24 captures an image of the medium that is conveyed along the conveying path 22. The conveying unit 23 further conveys the medium, from which the image has been captured, along the conveying path 22 and discharges the medium from the main body 2 via the discharge port 7. The image reading apparatus 1 repeatedly conveys a medium and captures an image of a medium until all of the plurality of media inserted into the insertion port 21 have been discharged.

After the images of the plurality of media have been read, the user rotates the placement board 5 toward the storage position and arranges the placement board 5 at the storage position. Gravity of the extension member 6 is added to the extension member 6 such that the extension member 6 moves toward the contraction position when the placement board 5 is located at the unfolding position. At this time, the gravity of the extension member 6 is added to the lever 45 such that the lever 45 moves toward the protrusion position. An elastic force of the spring 51 is further added to the lever 45 such that the lever 45 moves toward the protrusion position.

The end 49 of the placement board main body 31 of the placement board 5 is away from the body side abutting portion 47 as a result of the placement board 5 moving toward the storage position in the contact section. The lever 45 moves toward the protrusion position due to the gravity of the extension member 6 and the elastic force of the spring 51 when the end 49 of the placement board main body 31 is away from the body side abutting portion 47. A force that is needed for the placement board 5 to move toward the storage position in the contact section is reduced by the gravity of the extension member 6 added to the lever 45 and the elastic force of the spring 51.

The lever 45 is away from the body side abutting portion 47 when the placement board 5 is located in the separation section. The lever 45 is located at the protrusion position when the lever 45 is away from the body side abutting portion 47, and is fixed to the placement board main body 31 included in the placement board 5 in the state where the lever 45 is located at the protrusion position due to the elastic force of the spring 51. The extension member 6 is located at the contraction position as a result of the lever 45 being located at the protrusion position, and is fixed to the placement board main body 31 in the state where the lever 45 is located at the contraction position due to the elastic force of the spring 51. The placement board 5 is appropriately located at the storage position as a result of the extension member 6 being fixed to the placement board main body 31 in the state where the extension member 6 is located at the contraction position, and is thus able to be appropriately stored in the main body 2.

Figure 14:
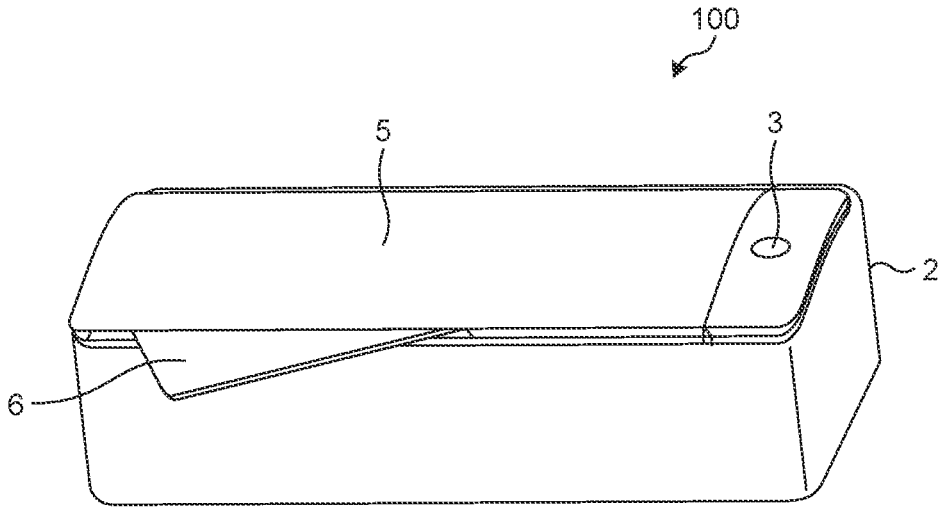
FIG. 14 is a perspective view of an image reading apparatus according to a comparative example.

Components of an image reading apparatus 100 according to the comparative example are the same as those of the image reading apparatus 1 described above except that the spring 51 is omitted from the above described image reading apparatus 1. FIG. 14 is a perspective view illustrating an image reading apparatus according to the comparative example. The extension member 6 included in the image reading apparatus 100 according to the comparative example sometimes moves toward the expansion position due to a centrifugal force when the placement board 5 moves toward the storage position while rotating about the rotation axis 8 at a high speed. In some cases, the placement board 5 included in the image reading apparatus 100 according to the comparative example is not appropriately located at the storage position as a result of the extension member 6 being stuck by the main body 2 when the extension member 6 is not located at the contraction position.

The image reading apparatus 1 includes the spring 51; therefore the image reading apparatus 1 is able to fix the extension member 6 at the contraction position due to the elastic force of the spring 51 working against the centrifugal force when the placement board 5 moves toward the storage position, and is thus able to appropriately locate the placement board 5 at the storage position.

Effects of Medium Conveying Apparatus According to First Embodiment

The medium conveying apparatus according to the first embodiment includes the main body 2, the placement board 5, the extension member 6, the lever 45, and the expansion-and-contraction mechanism 46. The main body 2 has the conveying path 22 for conveying a medium formed thereon. The placement board 5 is supported by the main body 2 so as to be rotatable about the rotation axis 8 such that the placement board 5 moves between the storage position and the unfolding position via the midway position, and on which the medium is placed. The extension member 6 is supported by the placement board 5 so as to be movable between the contraction position and the expansion position. The lever 45 is supported by the placement board 5 so as to be movable between the protrusion position and the pushed position. The expansion-and-contraction mechanism 46 converts a motion of the lever 45 to a motion of the extension member 6 such that the extension member 6 is located at the contraction position when the lever 45 is located at the protrusion position and such that the extension member 6 is located at the expansion position when the lever 45 is located at the pushed position. The lever 45 is away from the body side abutting portion 47 that is fixed to the main body 2 when the placement board 5 is located in the separation section between the storage position and the midway position. The lever 45 comes into contact with the body side abutting portion 47 and moves toward the pushed position when the placement board 5 is located in the contact section between the unfolding position and the midway position and when the placement board 5 moves toward the unfolding position. The medium conveying apparatus according to the first embodiment is able to prevent the extension member 6 from moving toward the expansion position because the lever 45 is away from the body side abutting portion 47 when the placement board 5 is located in the separation section. The medium conveying apparatus according to the first embodiment is able to reduce a force needed for an operation of moving the placement board 5 to the unfolding position when the placement board 5 is located in the separation section as a result of the extension member 6 being prevented from moving toward the expansion position.

Furthermore, in the medium conveying apparatus according to the first embodiment, a first point, at which a center of gravity of the placement board 5 and the extension member 6 is located when the placement board 5 is located at the storage position, is located on the front side relative to the vertical plane 15. The vertical plane 15 overlaps with the rotation axis 8 and is perpendicular to an installation plane that is along the installation surface 10 on which the main body 2 is placed. A second point, at which the center of gravity of the placement board 5 and the extension member 6 is located when the placement board 5 is located at the unfolding position, and a third point, at which the center of gravity of the placement board 5 and the extension member 6 is located when the placement board 5 is located at the midway position, are located on the rear side relative to the vertical plane 15. A distance from the third point to the installation plane is larger than a distance from the second point to the installation plane. The gravity of the placement board 5 and the extension member 6 is converted to a force that causes the extension member 6 to move toward the expansion position when the installation surface 10 is along the horizontal plane, so that the medium conveying apparatus according to the first embodiment is able to reduce a force needed for an operation of moving the placement board 5 to the unfolding position in the contact section.

Furthermore, the lever 45 included in the medium conveying apparatus according to the first embodiment is supported by the placement board 5 so as to be rotatable about the rotation axis 48 that is different from the rotation axis 8. The extension member 6 is supported by the placement board 5 so as to be rotatable about the rotation axis 40 that is parallel to the rotation axis 48. The rotation axis 48 of the lever 45 and the rotation axis 40 of the extension member 6 are parallel, so that the medium conveying apparatus according to the first embodiment is able to simplify the structure of the expansion-and-contraction mechanism 46 and is thus able to reduce the manufacturing cost.

Furthermore, a center of gravity of the extension member 6 included in the medium conveying apparatus according to the first embodiment is located at a fourth point when the placement board 5 is located in the contact section and when the extension member 6 is located at the expansion position. A center of gravity of the extension member 6 is located at a fifth point when the placement board 5 is located in the contact section and when the extension member 6 is located at the contraction position. The fourth point and the fifth point are located on the left side of the vertical plane 42. The vertical plane 42 overlaps with the rotation axis 40 and is perpendicular to the installation plane. A distance from the fourth point to the installation plane is larger than a distance from the fifth point to the installation plane. In this case, the extension member 6 moves toward the contraction position due to the gravity of the extension member 6 and is located at the contraction position. With the medium conveying apparatus according to the first embodiment, there is no need to additionally arrange a mechanism for applying, to the extension member 6, a force that causes the extension member 6 to move toward the contraction position; therefore, it is possible to simplify the structure and reduce the manufacturing cost.

Furthermore, the expansion-and-contraction mechanism 46 of the medium conveying apparatus according to the first embodiment includes the spring 51 that applies a force to the extension member 6 such that the extension member 6 moves toward the contraction position. The medium conveying apparatus according to the first embodiment reliably locate the extension member 6 at the contraction position as a result of the spring 51 being provided. The medium conveying apparatus according to the first embodiment is able to appropriately locate the placement board 5 at the storage position and appropriately store the placement board 5 in the main body 2 as a result of the extension member 6 being reliably located at the contraction position.

Furthermore, the spring 51 included in the medium conveying apparatus according to the first embodiment applies an elastic force to the lever 45 such that the lever 45 moves toward the pushed position. A force that causes the placement board 5 to move toward the unfolding position in the contact section is able to work against the elastic force of the spring 51 without passing through the expansion-and-contraction mechanism 46, so that the medium conveying apparatus according to the first embodiment is able to reduce a force needed for an operation of moving the placement board 5 toward the unfolding position.

Second Embodiment

Figure 15:
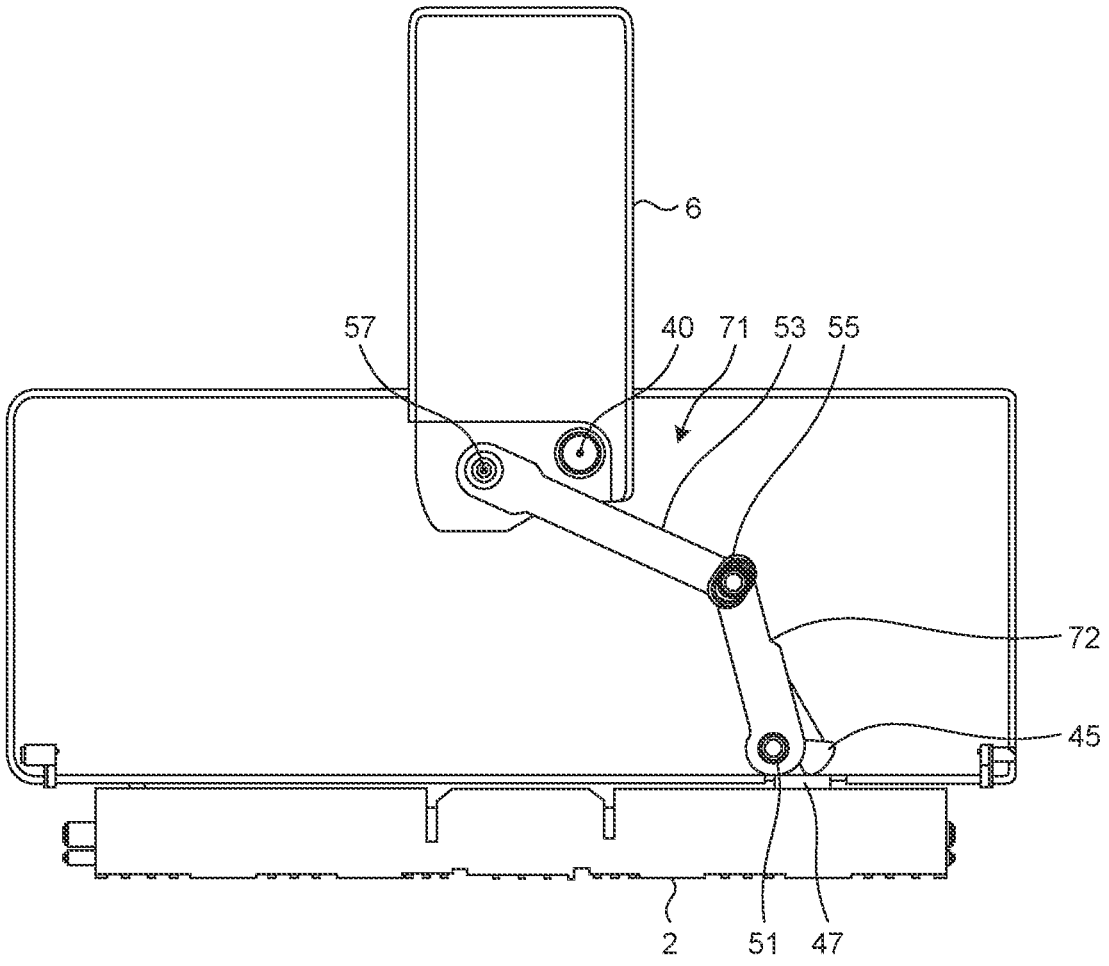
FIG. 15 is a plan view illustrating an expansion-and-contraction mechanism of a medium conveying apparatus according to a second embodiment.

In a medium conveying apparatus according to a second embodiment includes, as illustrated in FIG. 15, the expansion-and-contraction mechanism 46 included in the above described medium conveying apparatus according to the first embodiment is replaced with another expansion-and-contraction mechanism 71, and the other components are the same as those included in the above described medium conveying apparatus according to the first embodiment. FIG. 15 is a plan view illustrating the expansion-and-contraction mechanism 71 of the medium conveying apparatus according to the second embodiment. In the expansion-and-contraction mechanism 71, the lever side link 52 that is included in the expansion-and-contraction mechanism 46 described above is replaced with a lever side link 72, and the other components are the same as those included in the expansion-and-contraction mechanism 46 described above. In other words, the expansion-and-contraction mechanism 71 includes the spring 51, the lever side link 72, and the extension member link 53.

Figure 16:
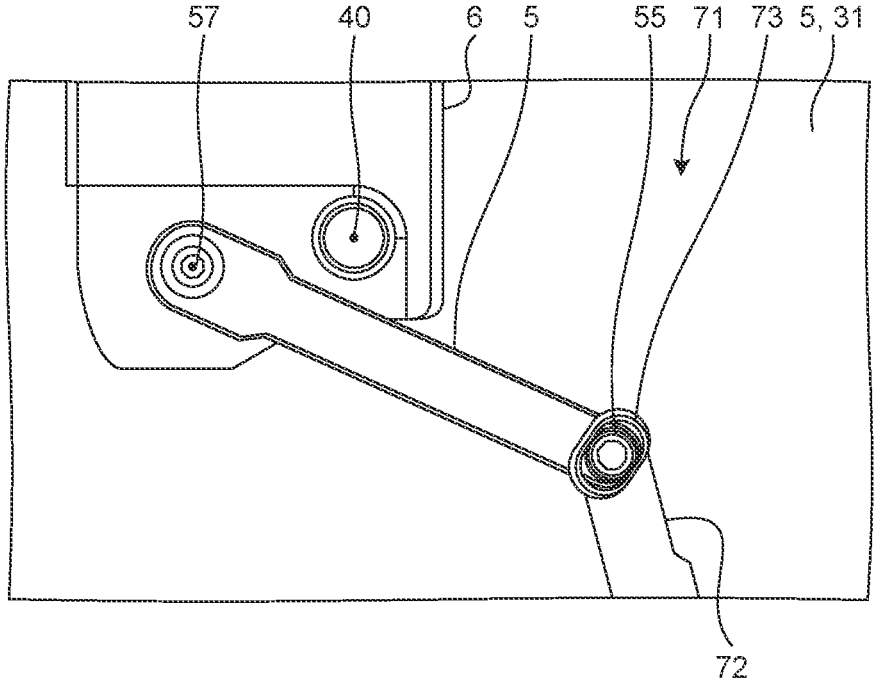
FIG. 16 is an enlarged plan view illustrating the expansion-and-contraction mechanism of the medium conveying apparatus according to the second embodiment.

The lever side link 72 is formed in a rod shape. The lever side link 72 is supported by the placement board main body 31 so as to be rotatable about the rotation axis 48 and is fixed to the lever 45. As illustrated in FIG. 16, an elongated hole 73 is formed at the other end that is an opposite side of one end linked to the lever 45 included in the lever side link 72. FIG. 16 is an enlarged plan view illustrating the expansion-and-contraction mechanism 71 of the medium conveying apparatus according to the second embodiment. The straight line along which the elongated hole 73 is arranged is inclined with respect to the straight line along which the lever side link 72 is arranged. The pin 55 is fitted into the elongated hole 73 and is able to move translationally along the elongated hole 73. The extension member link 53 is supported by the lever side link 72 so as to be rotatable about the pin 55 as a result of the pin 55 being fitted into the elongated hole 73.

The expansion-and-contraction mechanism 71 formed in this way converts a movement of the lever 45 to a movement of the extension member 6 such that the extension member 6 is located at a position associated with a position in which the lever 45 is located. In other words, the expansion-and-contraction mechanism 71 is formed such that the extension member 6 is located at the expansion position when the lever 45 is located at the pushed position.

Figure 17:
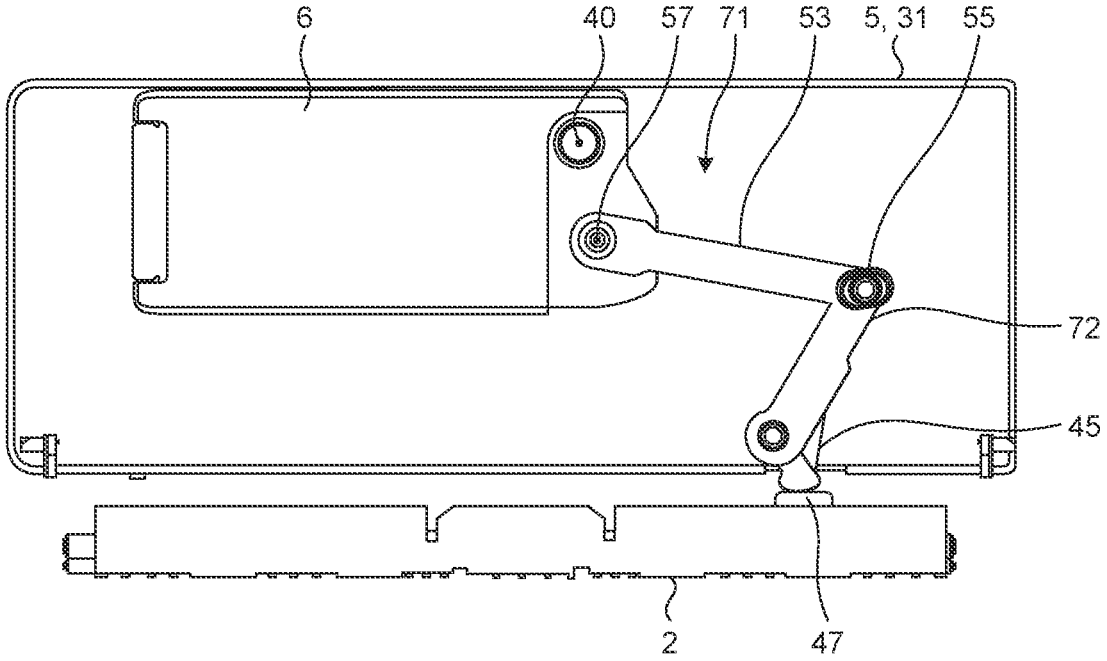
FIG. 17 is a plan view illustrating the expansion-and-contraction mechanism of the medium conveying apparatus according to the second embodiment when the lever is located at a protrusion position.

The extension member 6 is located at the contraction position, as illustrated in FIG. 17, when the lever 45 is located at the protrusion position. FIG. 17 is a plan view illustrating the expansion-and-contraction mechanism 71 of the medium conveying apparatus according to the second embodiment when the lever 45 is located at the protrusion position. In other words, the expansion-and-contraction mechanism 71 is further formed such that the extension member 6 is located at the contraction position when the lever 45 is located at the protrusion position. The medium conveying apparatus according to the second embodiment is able to reduce a force of unfolding the placement board 5 as a result of the lever 45 not coming into contact with the body side abutting portion 47 when the placement board 5 is positioned in the separation section.

In some cases, the expansion-and-contraction mechanism 46 of the medium conveying apparatus according to the first embodiment described above is not able to be appropriately assembled in a case where the size of each component of the expansion-and-contraction mechanism 46 varies. The medium conveying apparatus according to the second embodiment is able to appropriately assemble the expansion-and-contraction mechanism 71 even if the size of each component of the expansion-and-contraction mechanism 71 varies as a result of the elongated hole 73 being formed at the lever side link 72.

Incidentally, the spring 51 is arranged in the medium conveying apparatus according to the embodiment described above; however, the spring 51 may be omitted. Even if the spring 51 is omitted, the medium conveying apparatus is able to reduce a force of unfolding the placement board 5 as a result of the lever 45 not coming into contact with the body side abutting portion 47 when the placement board 5 is located in the separation section.

Incidentally, the medium conveying apparatus according to the embodiment described above is used for the image reading apparatus 1; however, the medium conveying apparatus may be used for another device. An example of the device includes a printer that prints characters or a graphic on a medium. In the printer, the reading unit 24 included in the medium conveying apparatus according to the above described embodiment is replaced with a printing unit that prints characters or a graphic on a medium that is conveyed along the conveying path 22. In this case, the medium conveying apparatus is also able to reduce a force of unfolding the placement board 5.

The medium conveying apparatus of the present disclosure is able to reduce a force needed to unfold the placement board.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveying apparatus comprising:

a main body in which a conveying path for conveying a medium is formed;

a placement board that is supported by the main body so as to be rotatable about a rotation axis such that the placement board moves between a storage position and an unfolding position via a midway position, and on which the medium is placed;

an extension member that is movably supported by the placement board so as to move between a contraction position and an expansion position;

a lever that is movably supported by the placement board so as to move between a protrusion position and a pushed position; and a mechanism that converts a motion of the lever to a motion of the extension member such that the extension member is located at the contraction position when the lever is located at the protrusion position, and the extension member is located at the expansion position when the lever is located at the pushed position, wherein the lever is away from an abutting portion fixed to the main body when the placement board is located in a separation section between the storage position and the midway position, and the lever comes into contact with the abutting portion and moves toward the pushed position when the placement board is located in a contact section between the unfolding position and the midway position and when the placement board moves toward the unfolding position.

2. The medium conveying apparatus according to claim 1, wherein a first point, at which a center of gravity of the placement board and the extension member is located when the placement board is located at the storage position, is located on one side of a vertical plane, the vertical plane overlaps with the rotation axis and is perpendicular to an installation plane that is along an installation surface on which the main body is placed, a second point, at which a center of gravity of the placement board and the extension member is located when the placement board is located at the unfolding position, and a third point, at which a center of gravity of the placement board and the extension member is located when the placement board is located at the midway position, are located on an opposite side of the one side, and a distance from the third point to the installation plane is larger than a distance from the second point to the installation plane.

3. The medium conveying apparatus according to claim 2, wherein the lever is supported by the placement board so as to be rotatable about a first rotation axis that is different from the rotation axis, and the extension member is supported by the placement board so as to be rotatable about a second rotation axis that is parallel to the first rotation axis.

4. The medium conveying apparatus according to claim 3, wherein a fourth point, at which a center of gravity of the extension member is located when the placement board is located in the contact section and when the extension member is located at the expansion position, and a fifth point, at which a center of gravity of the extension member is located when the extension member is located at the contraction position, are located on one side of another vertical plane, the other vertical plane overlaps with the second rotation axis and is perpendicular to the installation plane, and a distance from the fourth point to the installation plane is larger than a distance from the fifth point to the installation plane.

5. The medium conveying apparatus according to claim 3, wherein the mechanism includes a link that is supported by the extension member so as to be rotatable about a third rotation axis that is parallel to the second rotation axis, a pin that is fixed to the link, and a connecting portion that is fixed to the lever, the link is further supported by the connecting portion so as to be rotatable as a result of the pin being fitted into an ellipse that is formed on the connecting portion, and the pin is able to move translationally with respect to the lever along the ellipse.

6. The medium conveying apparatus according to claim 1, wherein the mechanism includes a biasing portion that applies a force to the extension member such that the extension member moves toward the contraction position.

7. The medium conveying apparatus according to claim 6, wherein the biasing portion applies the force to the extension member by applying an elastic force to the lever such that the lever moves toward the pushed position.

* * * * *